US007006076B2

(12) United States Patent
Fougere

(10) Patent No.: US 7,006,076 B2
(45) Date of Patent: Feb. 28, 2006

(54) DART GAME SCORE BOARD

(76) Inventor: Willard F. Fougere, 442 High St., Summersworth, NH (US) 02878

( * ) Notice: Subject to any disclaimer, the term of this patent is extended or adjusted under 35 U.S.C. 154(b) by 669 days.

(21) Appl. No.: 09/736,787

(22) Filed: Dec. 15, 2000

(65) Prior Publication Data

US 2002/0075238 A1 Jun. 20, 2002

(51) Int. Cl.
*G09G 5/00* (2006.01)

(52) U.S. Cl. ..... 345/168; 273/108; 273/108.5; 700/92

(58) Field of Classification Search ..... 264/30; 280/124.157; 273/371, 108, 108.5; 340/323 R; 700/92; 345/156, 173, 168
See application file for complete search history.

(56) References Cited

U.S. PATENT DOCUMENTS 4,286,323 A * 8/1981 Meday ..... 700/92
4,567,461 A * 1/1986 Honekman et al. ..... 340/323 R
4,900,027 A * 2/1990 Sheridan ..... 700/92
5,384,561 A * 1/1995 Smith ..... 340/323 R
5,401,003 A * 3/1995 Aizatulov et al. ..... 264/30
5,552,758 A * 9/1996 Tobin ..... 340/323 R
5,559,490 A * 9/1996 McDonald et al. ..... 340/323 R
5,648,752 A * 7/1997 Alfrey ..... 340/323 R
5,743,533 A * 4/1998 Wiles et al. ..... 280/124.157
5,755,443 A * 5/1998 Huang ..... 273/371
5,971,397 A * 10/1999 Miguel et al. ..... 273/371
6,279,912 B1 * 8/2001 Martin et al. ..... 273/371
2002/0135131 A1 * 9/2002 Martin et al. ..... 273/371

FOREIGN PATENT DOCUMENTS

EP 0974807 A2 * 1/2000

* cited by examiner

*Primary Examiner*—Chanh Nguyen
*Assistant Examiner*—Srilakshmi K Kumar
(74) *Attorney, Agent, or Firm*—Dennis G. LaPointe

(57) ABSTRACT

A dart game score board includes a case having a front face with two orthogonal arrays of display windows, a plurality of number keys and cancel buttons, two keypads, each having a four digit display, electronic circuitry having a microprocessor and processing firmware programmed to contain the instructions in the source code list, and a microprocessor data/command input-output generator and computational device.

3 Claims, 4 Drawing Sheets

DART GAME SCORE BOARD

BACKGROUND OF THE INVENTION

The present invention relates generally to game score boards and more particularly to score boards for keeping the scores of single and multiple players playing the various games of darts.

DESCRIPTION OF THE PRIOR ART

Darts is a game which maybe played in a variety of ways. While all dart games employ a target and a group of throwing darts for each opponent, the manner in which a game may be played and scored can be varied in many ways. The game of darts has evolved into a number of different games, each having a different set of rules as well as different scoring arrangements. The games differ primarily in the arithmetics involved by which the individual scores obtained by each of the players, throwing successive sets of darts at the target, are added or subtracted to achieve a winning score. Some of these games have rather elaborate or complex scoring rules, whereas the scoring rules for other games is less complex.

The "standard game" of darts among the majority of dart players is probably the most popular. The game starts with an initial score which may be 301, 401, 501, 701, etc. The object of the standard game is to get rid of points. This reduction of points is accomplished by each player, in turn, throwing a set of three darts. A set score is obtained by adding the numbers of the dartboard segments on which each of the three darts has landed. This set score is subtracted from the beginning score (e.g. 301 if that score is chosen as the beginning or initial score). The set score achieved by each player taking his turn throwing the set of 35 three darts is subtracted from the beginning score of each player to obtain a first intermediate score for each player. Successive sets of three darts are thrown by turns of the opposing players to obtain further intermediate scores by subtracting each intermediate score from the previous corresponding intermediate score of each player to further reduce the scores of the respective players. The game ends when a player's last dart is thrown and the scoring of that dart is twice (referred to as a double) the number equal to one half the last intermediate score of that player throwing his dart. The above standard game is one class of games wherein intermediate scores are subtracted from a beginning score. A second popular game, referred to generally as "cricket", is somewhat more complex than the standard game and differs from that game in that intermediate scores are added to accumulate a final or ending score.

In the game of cricket the players are required to score three dart landings in each of the dart board beds (also referred to as pies) numbered 15 through 20 plus three darts in the bulls eye. Each number (15–20) represents scoring possibilities. In addition, as is well known in the standard game of darts, doubles and trebles when hit by a dart are worth their normal values. To score on a particular number, a player must bring that number alive by hitting it three 60 times. Once accomplished, any dart thrown into that number by that player with it alive scores. If the opponent places three darts in that same live number, that number becomes dead (i.e., it is no longer in the game). In the game of cricket, the beginning score is zero and successive score points are added to keep an increasing total of the point scores for each player. Thus a cumulative point score is kept for each of the players. The winner of the game is the player who first lands three darts in each of the beds, or pies, between 15 and 20, three bulls eyes, and who has the highest point score.

The above descriptions have provided the basic highlights of scoring for the various games of darts, however, those descriptions are not detailed. For detailed information regarding practically all aspects of the games of darts, reference is made to the book entitled-All About Darts, by I. L. Brackin and W. Fitzgerald, Published by Contemporary 10 Books, Inc.; Library of Congress Catalog Card Number: 76-29366; International Standard Book Number: 0-8092-4984-7.

Historically, dart game scores have been kept by recording the scores on a chalkboard. Dry erase ink boards are also sometimes used as scoreboards. The use of these types of scoreboards have several shortcomings. The legibility of the scores is directly dependent upon the hand writing quality of the scorekeeper. Because the game of darts is most frequently played in "Pubs" and "Taverns", the quality and visibility of the scores to the players and the audience may not be totally adequate for viewing. In addition, chalk dust has a tendency to accumulate on the floor and adjacent furnishings. This accumulation can require an expensive clean up problem for Tavern proprietors. Further, the chalk dust on the floor has a tendency to be tracked around the tavern by customers and players, thus necessitating further clean up expense.

Because of the foregoing shortcomings, attempts have been made to construct various types of mechanical, electrical and electronic score keeping devices which would eliminate the contamination and clean up problems attendant with blackboards and also provide score numbers of sufficient size for adequate viewing by the audience and the players. While these devices may eliminate the clean up problems heretofore described, they have been, for the most part, commercially unsuccessful because of the expense and inconvenience attributed to; initial cost, spare or replacement parts costs, service repair costs (i.e., labor), and/or lack of quick and easy maintainability by the owner.

Various types of dart score keeping apparatus, including other types of game score keeping devices, are known to exist and which include all mechanical apparatus, as well as electronic devices having circuits for calculating scores and displays of various types for displaying those scores. Different types of these scoring devices are disclosed in U.S. Pat. Nos. 700,738; 783,955; 935,844; 1,953,630; 4,003,579; 4,651,998, 4,567,461; and 4,948,148.

In view of the foregoing, it can be seen that a need exists for a present invention apparatus which can he manufactured at reasonably low cost and which provides the attributes of: (i) ease of maintenance by the user or owner; (ii) rapid repair due to easily replaceable parts (an important feature during tournament play); (iii) large numerical display to enable players and spectators to readily see the scores of the players; (iv) allows players to play different types of dart games; and, (v) eliminates the mess historically caused by chalk board score keeping devices, thus eliminating the need for clean up and the costs associated therewith.

U.S. Pat. No. 5,555,840 issued Sep. 17, 1996 to Fougere discloses a Present invention which uses a series of mechanical display components adjustably mounted within a case having a front cover which has an orthogonal array of openings formed therein for displaying indicia representative of standard dart game scores. Fougere's invention provided a compact and useful means for scoring dart games, however, being mechanical in nature, it was subject to possible inaccuracies by users who make adjustments manually. It also lacked any illumination of the numerical display which, in taverns or other dimly lit venues, could be problematic.

OBJECTS OF THE INVENTION

It is, therefore, an object of the present invention to provided a present invention apparatus and system having enhanced structural and operational features and capabilities. Another object of this invention is to provide a present invention of the above type which is of modularized construction.

It is a further object of this invention to provide a present invention having dedicated electronic circuitry which replaces the mechanical components of the prior art devices.

SUMMARY OF THE INVENTION

In one aspect of the invention, a present invention is provided with a case having a front face which has at least one orthogonal array of windows or openings formed therein for displaying indicia representative of standard dart game scores.

The front face has a plurality of electronic scoring modules, equal in number to the number of window openings in the orthogonal array, disposed inside the case. The electronic scoring modules are each aligned with a corresponding window in the front cover and display the above mentioned indicia. Each scoring display module is electronically connected via dedicated electronic circuitry to a plurality of input keypads which are activated by the various players of the dart game.

In a further aspect of the invention the case houses an electronic circuit board connected to an external power source. Said keypads being connected to said circuit board act as an electromechanical interface by which the electronic display modules can be controlled. The keypads, by reason of their electronic programming, can be used to activate and score different dart games and permit reasonable control over input errors, allowing players or scorekeepers to recall previous scores and to make other corrections in the score displays.

BRIEF DESCRIPTION OF THE DRAWINGS

The foregoing objects, advantages, and features of the present invention may be more readily understood by one skilled in the art with reference being made to the following detailed description of the preferred embodiments thereof, taken in conjunction with the accompanying drawings in which.

DESCRIPTION OF THE PREFERRED EMBODIMENT

Figure 1:
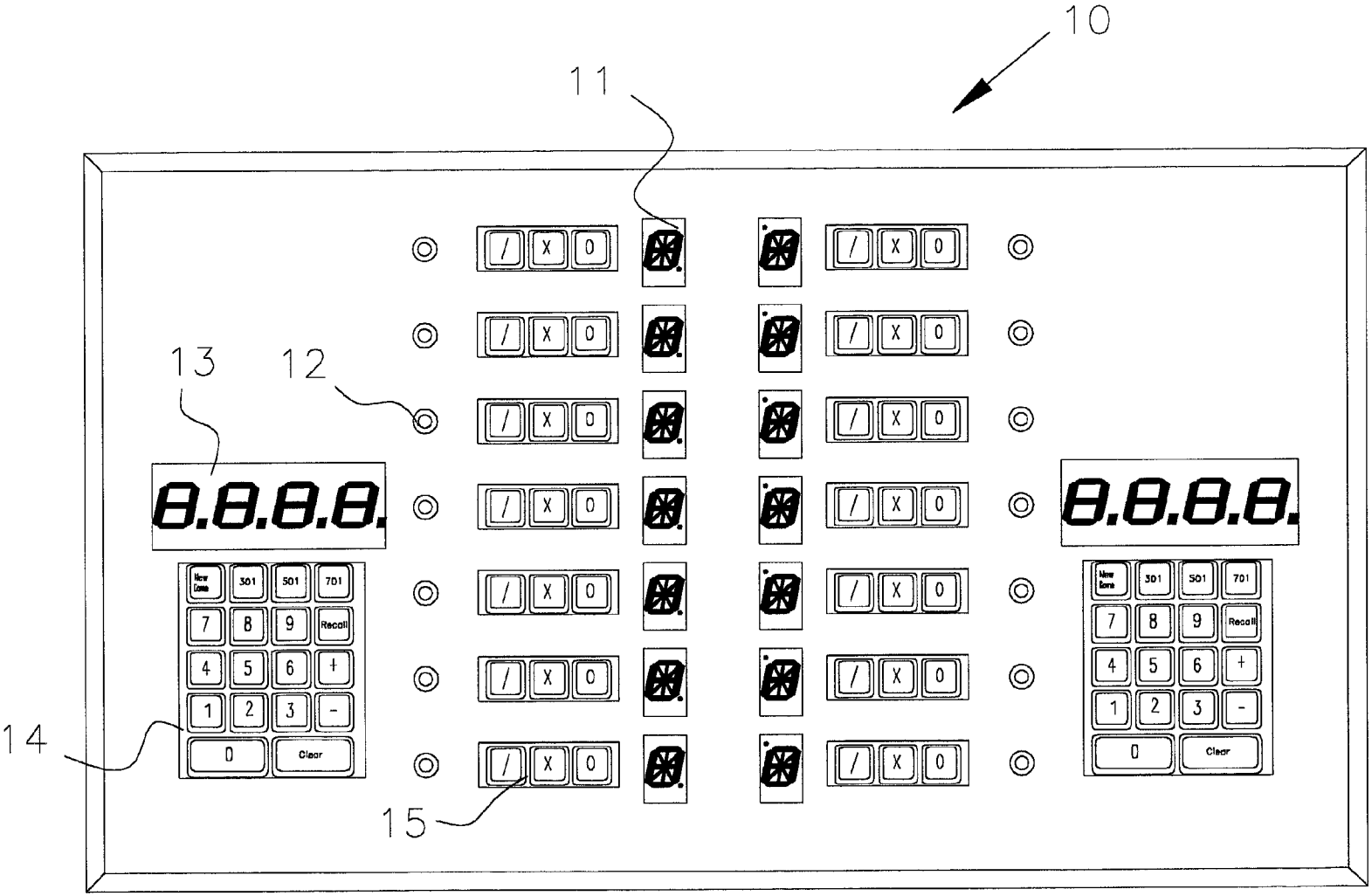
FIG. 1 is a front view of the present invention of the present invention illustrating the front face and the window openings through which the keypads and indicia are visible and accessible.

Referring now to drawings wherein like numerals are used throughout and in particular to FIG. 1 in which the invention is designated overall by the numeral 10. Central display 11 four digit display 13, cancel button 12

Figure 1A:
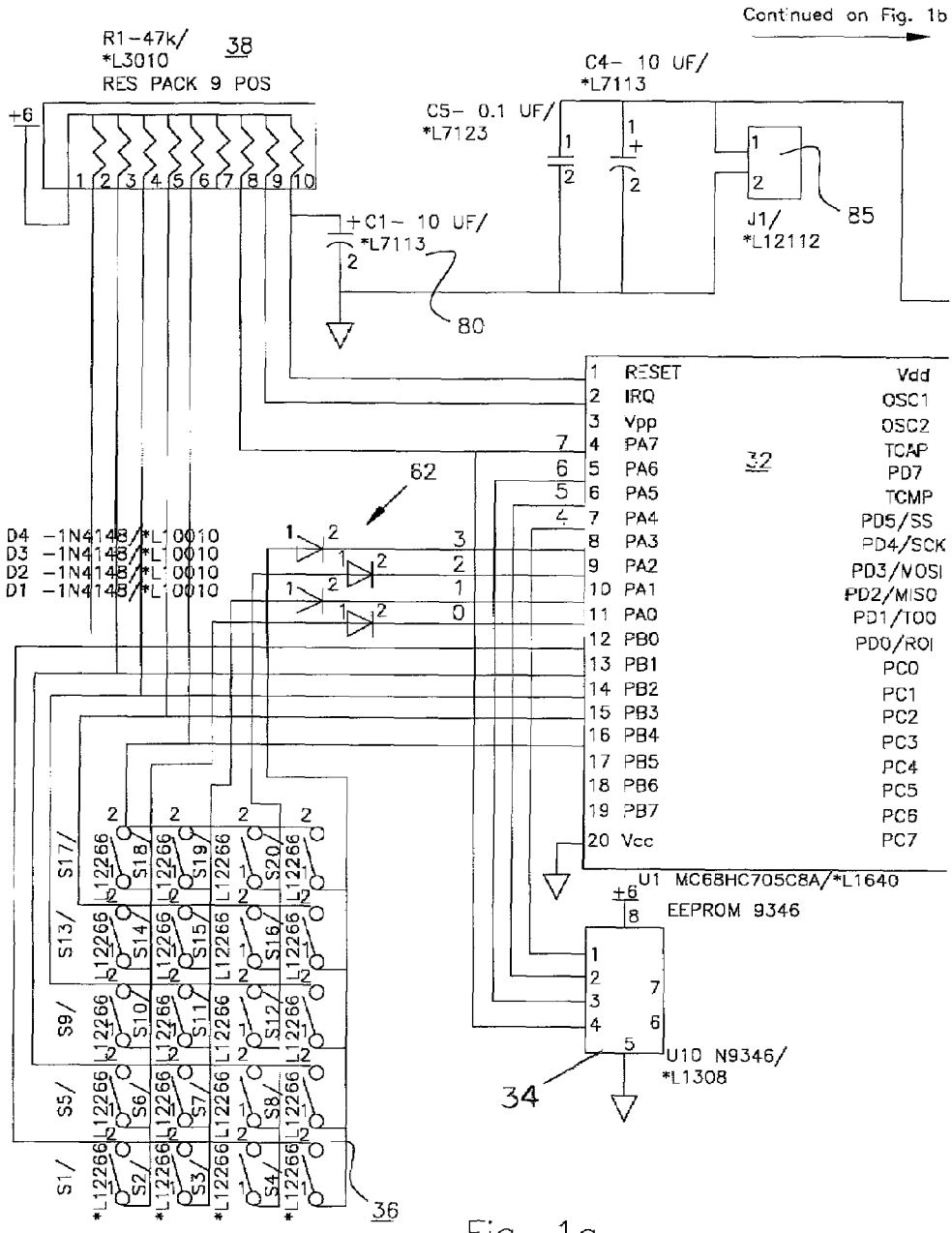
FIGS. 1*a* and 1*b* are two parts of the electronic circuit diagram of the present invention. Together these views disclose the circuitry used to control keypad inputs and one set (per side/player) of four digit L.E.D units for the display said inputs.
Figure 1B:
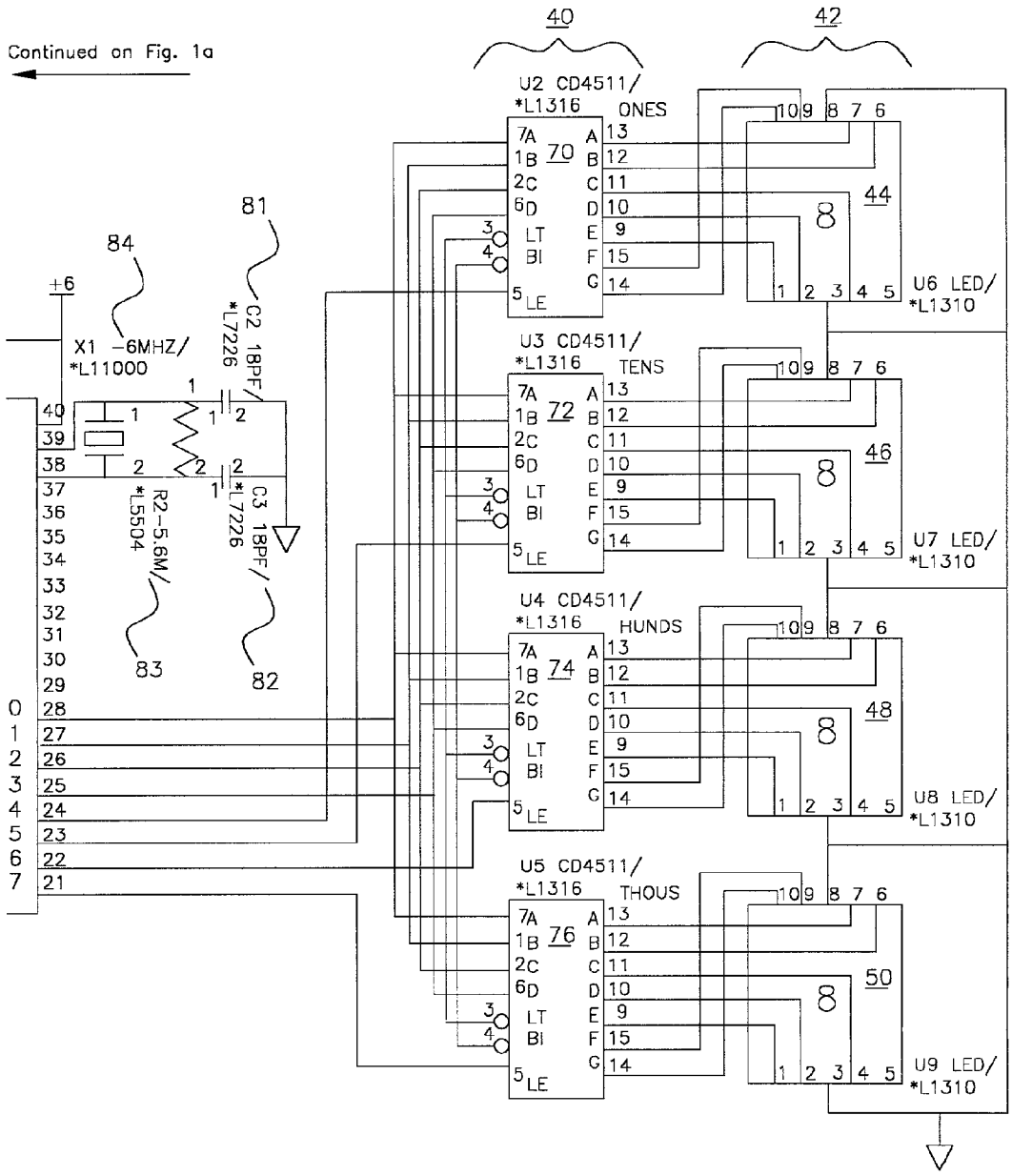

FIGS. 1*a–b* circuit diagram includes; microprocessor 32 read only memory 34, keypad 36, resistor pack 38, latch and decoder integrated circuits 40, 7 segment displays 42, units display 44, tens display 46, hundreds display 48, thousands display 50.

The present invention is designed for use by two players and the circuit described below is duplicated for the second player The microprocessor 32 is the data/command input, output generator and computational device for the present invention. When power is applied to the Dart game score board, the microprocessor is forced, by the Reset circuit to read the instructions contained within the read only memory. The read only memory contains a non-volatile set of instructions which directs the microprocessor to assign the function of the input and output pins and to initialize internal random access memory locations to specific values or zero as appropriate. Following the initialization routine, which forces values of 0 to the score register and outputs that value to the 4 digit latch/decoder circuit 40, the processor 32 begins the repetitive task of scanning for key press inputs from keypad 14.

The microprocessor first looks for the New Game key press entry on keypad 14, the game type, 301, 401, etc and stores appropriate values in the internal register (memory) locations, then the microprocessor outputs the value to the displays 42. The processor then returns to the key press scanning routine.

As the game progresses, data entries are made and the entry is displayed, +/−key press on keypad 14 confirms the data value, the processor 32 performs the calculation and the display is updated with the result of the calculation.

The read only memory 34 is an integrated circuit memory device, which is programmed to contain the instructions in the source code list. Programming the read only memory is done as part of the manufacturing/assembly process. The memory contents are non-volatile; that is, the memory contents are retained without power being applied to the device. (This ROM component is used in the design because the microprocessor used in the unit does not contain "read only memory" or does not contain a sufficient amount of read only memory to accomplish the task.) The keypad 14 in the present invention uses a four column by five row cross point switch matrix configuration. The switch matrix is used to generate the numeric value or function command to the microprocessor 32. Using the switch matrix allows twenty possible unique key entries to be encoded into a pattern defined by only nine signals. The five row signal lines are referenced to a voltage, which represents "logic level 1" (established by resistor group R1–47k 38). Under the control of the microprocessor 32, each of the four column signal lines are driven with a "logic 0" (zero) signal in a scan sequence such that only one of the four column lines is 0 at a given time, while the remaining three are not driven by a signal (and are prevented from confusing each other by the four diodes 62). The signal value of the five row lines is sensed by the microprocessor each time a given row signal line is driven to logic level 0 by the microprocessor. When a key is pressed, for example key #4, then the cross point switch between column #1 line and row #2 line are connected. During the time interval in the sequence when the microprocessor drives column #1 line to logic 0, the signal on row #2 line is at logic 0 since the key press #4 connects, row #2 to column #1. Thus the processor recognizes the cross point key press at column #1, row #2 and converts this to the numeric value 4 but looking up the column/row pattern in a firmware table, or by a calculation method. The microprocessor firmware program causes the keyboard crosspoint switch matrix to be scanned frequently enough that the user key entry will always be recognized. The processor firmware includes fault detection processing routines to detect multiple simultaneous key presses and key presses, which are intermittent due to insufficient key pressure being applied by the user.

The 7-segment displays 42 use light emitting diode (LED) arrays 44–50 to provide numeric information to the user. Energizing certain of the segments, which are separate elements arranged in a straight line FIG. 8 cause the desired numeric value 0–9 (in this case) to be visible. Although this design uses individual digit elements and latch/decoder circuitry, a production design would likely use a single unit display containing a 4 digit liquid crystal display (LCD) and the latch/decoder function as well.

The latch and decoder integrated circuit 40 is used to remove the burden of storing microprocessor numeric results and formatting those results to energize the appropriate segments of the display device. Display devices are made up of seven straight-line segments, which form the pattern "8", using seven separate elements (labeled A, B, C, D, E, F and G on units 70–76). The decoder function contained in the latch and decoder integrated circuit evaluates a numeric value at the 4-pin input (labeled A, B, C, and D) and resolves that into the segment pattern needed to display the value for human interpretation on display panel 13. The decoder performs the operation of a read only memory in that the A, B, C, D address applied to the input causes the unit to look-up the output segment pattern which corresponds to the A, B, C, D value. The decoder contains circuitry, which provides a current or voltage signal level, which is compatible with the operation of the 7 segment displays.

The latch function of the Latch/Decoder 40 is used to unburden the microprocessor. The microprocessor 32 has only a limited number of output signal pins and by use of the latch function, the processor uses the 4 output signal lines (A, B, C, D) to encode the value to be displayed and then a second group of 4 output pins to direct the A, B, C, D microprocessor output to the units, tens, hundreds or thousands digit latch/decoder.

The microprocessor 32 provides the result of the calculation (game score) which is in the form of a 3 (4) digit, 0–9 value, ranging from 0000 to 999(9) to the latch decoder by sequencing the microprocessor output pins. For example; were the calculated value 36, then the processor would format as follows:

Units digit, 6, thus A, B, C, D=0, 1, 1, 0 binary on PC0, 1, 2, 3 and PC4>0, >1, >0 that is, the value PC4 microprocessor output, which rests at 0, would change to 1, causing the latch input to view the A, B, C, D signals, then the PC4 signal would return to 0, thus causing the latch input to be retained. The decoder function would energize all segments except the upper, vertical, right segment, thus producing a 6 display.

Tens digit, 3, thus A, B, C, D=1, 1, 0, 0 binary on PC0, 1, 2, 3 and PC5>0, >1, >0 thus latching the Tens digit. The decoder function would energize all segments except the vertical, left segments, thus producing a 3 display.

The primary functional elements are the microprocessor 32, read only memory 34, keypad 36, 7 segment displays 42 and the latch and decoders 40. In order for those elements to be interfaced, support circuitry is used. Resistor array 38, R1-47*k* is used to establish the logic 1 reference for the row output of the keypad cross point switch. Diodes 62, 1-4, provide isolation so that back circuits are avoided. Capacitor 80 (C1) forces the microprocessor 32 Reset input pin to a logic 0 state, when the power is initially applied, for a time sufficient for the microprocessor to recognize the Reset condition and to begin execution of the Initialization routine.

Capacitors 81 (C2) and 82 (C3) in conjunction with resistor 83 (R2) and crystal 84 (X1) form a circuit which causes the microprocessors internal clock function to operate.(The microprocessor internal clock is the heartbeat in the microprocessor which steps the microprocessor through the instructions contained in the read only memory)

Connector 85 (J1) provides an entry point for 6 volt DC power for the unit.

Figure 2:
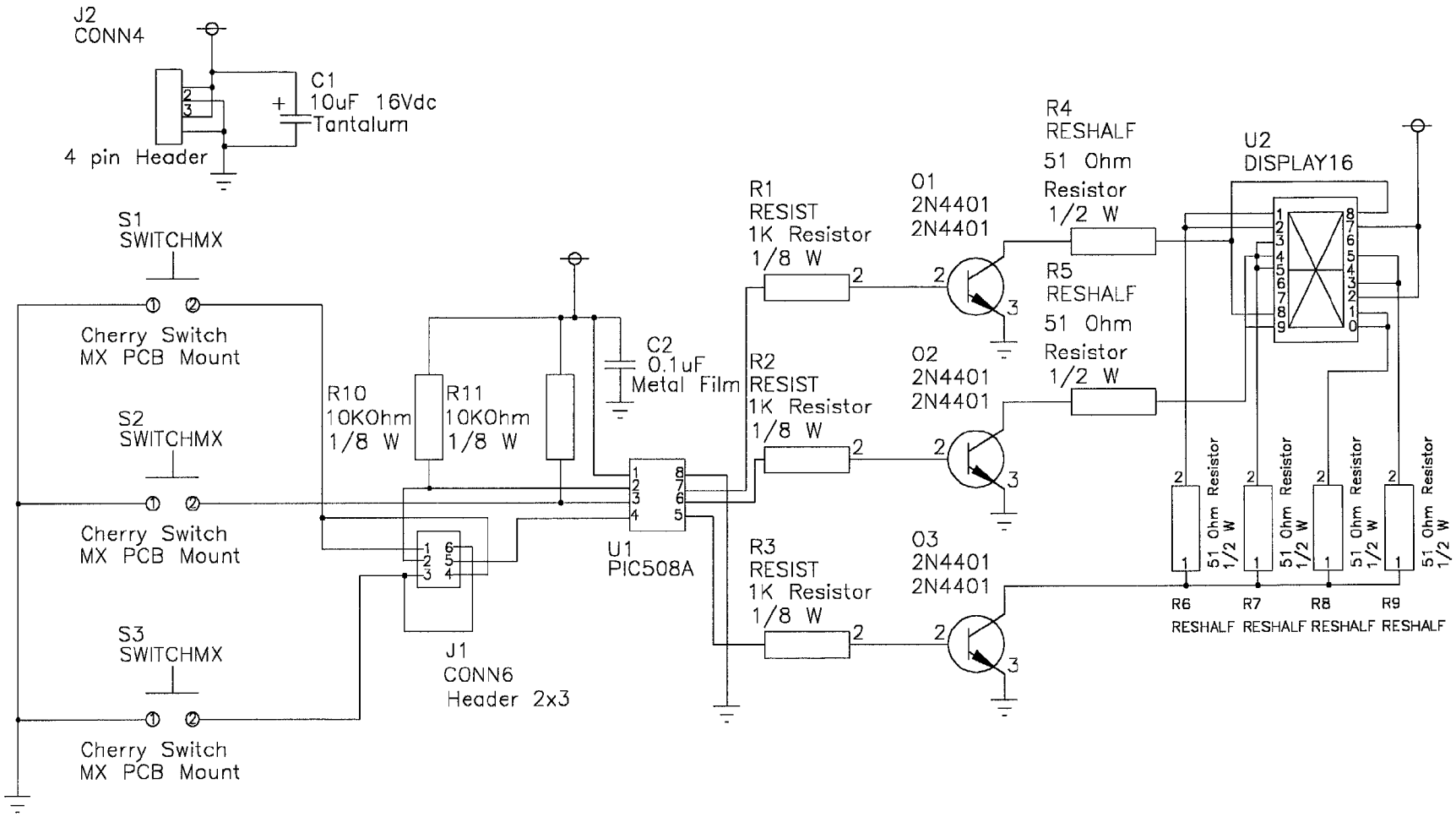
FIG. 2 is a circuit diagram for the control of the central display of FIG. 1.

FIG. 2 component diagram contains microprocessor 60 (PIC508A) and its support circuitry for control of central display 11 (FIG. 1)

In operation during the playing of a darts game, the following sequence is followed;

1. "New Game" key (keypad 14) is pressed to start a new game. (If "New Game" is pressed in error during game play, the "Recall" key will restore the game total.)
2. A pre-set game is selected (301,501,701) or a game set by typing in any required number.
3. "New Game" key is again pressed to confirm the selection and to register the new game start total.
4. After the player has thrown, the score is entered using the number keys and then the "−" (minus) key is pressed.
5. If the player realizes a keying error before pressing the minus key, the "Clear" key will erase the incorrect entry and return the previous total to the display.
6. If an error is realized after the minus key has been pressed, the previous score can be recovered to the display by pressing the "Recall" key.
7. Pressing the "+" (plus) key will add to the current total the score just entered via the key pad.

In the event a score greater than the remaining total is entered and subtracted, it will be rejected and the previous total redisplayed. The latter is true for only one step back, if a player enters each dart's score separately, the keypad will be unable to restore the total to what it was before that player's turn.

An "Add Up" game can be played by beginning at 0, entering the score and pressing the "=" (plus) key.

The subject invention has been described with reference to certain embodiments. It will be understood by those skilled in the art to which this invention pertains that the scope and spirit of the appended claims should not necessarily be limited to the embodiments described in detail herein.

What is claimed is:

1. A system for manually inputting and keeping the scores of one or two players playing the various games of darts, said system consisting essentially of:

a case, said case having a central display, the central display consisting of two separate means, one for each two players, for displaying each player's dart hit in each corresponding pie-shaped region of a dart board, the dart hit displaying means for each corresponding pie-shaped region of the dart board including one button for activating a single "slash" symbol display on a lighted window representing one hit in the pie-shaped region, a separate button for activating an "X-shaped" symbol displayed on the lighted window representing two hits in the pie-shaped region, and another separate button for activating a "O-shaped" symbol displayed on the lighted window representing three hits in the pie-shaped region, said central display further consisting of cancel button means for each corresponding pie-shaped region of the dart board, for canceling a previously recorded hit, two keypads, each associated with a respective four digit display for displaying dart game scores for each player, the keys of each keypad including an individual key for starting a new game, at least three individual keys for playing a game at a predetermined point level, an individual key for recalling a previous entry, a clearing key, a key for each number 0–9, a plus sign key and a minus sign key, electronic circuitry means for connecting and controlling said central display and keypads, and said circuitry means being programmed for activation and scoring a plurality of dart score games, providing control over input errors, allowing scorekeepers to recall previous scores, and making other corrections in the score displays.

2. The system according to claim 1, wherein:

each keypad consists of a four column by five row cross point matrix configuration for generating a numeric value/function command, said electronic circuitry means having a microprocessor, said microprocessor comprises processing firmware, a read only memory, programmed to contain the instructions in the source code list, and a microprocessor data/command input-output generator and computational device, and each of said four digit display consisting of a seven segment display using light diode arrays which are separate elements arranged in a straight line figure eight for displaying the desired numeric values 0–9.

3. A system for manually inputting and keeping the scores of one or two players playing the various games of darts, said system consisting essentially of:

a case, said case having a central display, the central display consisting of two separate means, one for each two players, for displaying each player's dart hit in each corresponding pie-shaped region of a dart board, the dart bit displaying means for each corresponding pie-shaped region of the dart board including one button for activating a single "slash" symbol display on a lighted window representing one hit in the pie-shaped region, a separate button for activating an "X-shaped" symbol displayed on the lighted window representing two hits in the pie-shaped region, and another separate button for activating a "O-shaped" symbol displayed on the lighted window representing three hits in the pie-shaped region, said central display further consisting of cancel button means for each corresponding pie-shaped region of the dart board, for canceling a previously recorded hit, two keypads, each associated with a respective four digit display for displaying dart game scores for each player, the keys of each keypad including an individual key for starting a new game, at least three individual keys for playing a game at a predetermined point level, an individual key for recalling a previous entry, a clearing key, a key for each number 0–9, a plus sign key and a minus sign key, electronic circuitry means for connecting and controlling said central display and keypads, and said circuitry means being programmed for activation and scoring a plurality of dart score games, providing control over input errors, allowing scorekeepers to recall previous scores, and making other corrections in the score displays, wherein:

each keypad consists of a four column by five row cross point matrix configuration for generating a numeric value/function command, said electronic circuitry means having a microprocessor, said microprocessor comprises processing firmware, a read only memory, programmed to contain the instructions in the source code list, and a microprocessor data/command input-output generator and computational device, and each of said four digit display consisting of a seven segment display using light diode arrays which are separate elements arranged in a straight line figure eight for displaying the desired numeric values 0–9.

* * * * *